US005806254A

United States Patent [19]

Bennett

[11] Patent Number: 5,806,254

[45] Date of Patent: Sep. 15, 1998

[54] MODULAR TREAD AND RISER UNIT

[76] Inventor: Michael Hebden Bennett, 1 Doonside Road, Kerikeri, Northland, New Zealand

[21] Appl. No.: 653,206

[22] Filed: May 24, 1996

[51] Int. Cl.[6] ..... E04F 11/00; E04F 19/10

[52] U.S. Cl. ..... 52/182; 52/190; 52/188; 52/191; 52/187; 52/712; 248/300

[58] Field of Search ..... 52/182, 188, 190, 52/191, 187, 712; 248/300

[56] References Cited

U.S. PATENT DOCUMENTS

| | | | |
|---|---|---|---|
| 4,583,334 | 4/1986 | Hubbard | 52/182 X |
| 4,850,164 | 7/1989 | McLeod | 52/187 X |
| 5,293,722 | 3/1994 | Reimann | 52/182 |

FOREIGN PATENT DOCUMENTS

| | | | |
|---|---|---|---|
| 2544773 | 10/1984 | France | 52/182 |
| 6294192 | 10/1994 | Japan | 52/182 |
| 8902506 | 3/1989 | WIPO | 52/182 |

*Primary Examiner*—Carl D. Friedman
*Assistant Examiner*—W. Glenn Edwards
*Attorney, Agent, or Firm*—Darby & Darby

[57] ABSTRACT

Flanged Triangular elements for constructing a stairway which can be joined to provide a beam having adjacent tread and riser mounting portions.

6 Claims, 5 Drawing Sheets

MODULAR TREAD AND RISER UNIT

TECHNICAL FIELD

This invention relates to a modular tread and riser unit, which may be especially useful in relation to stairway construction.

BACKGROUND ART

Stairways are an important feature of many buildings, both for access and for appearance. Thus, it is extremely important that stairways are designed aethestically, and to give the appropriate strength for them to function as access ways.

Current methods of designing stairways suffer from a number of disadvantages. For example U.S. Pat. No. 5,293,722 relates to a construction unit suitable for making stair stringers. These units consist of a number of substantially triangular shaped units, which include channels which run along the inside of the periphery of the construction unit. The triangular shape of the unit allows two of the sides of the unit to form the riser and tread portions of the stair while the third side (the hypotenuse) provides a support and connecting means.

This unit is envisaged to be used in kitset (or other) form and it is envisaged to provide a simple means for constructing a stairway. However, this unit also suffers from a number of disadvantages. These include;

(1) these construction units cannot be abutted or joined together in any way (except through using intermediary members such as beams). Thus, stairways made from these construction units offer suffer from strength difficulties.

(2) The provision of channels in a construction unit adds to the complexity and the cost of these units. In addition, the channels provided are often quite weak, and when used to support tread sheets can often break or be damaged in other ways.

(3) These units are typically made from a material such as plastic. Plastic also tends to suffer from a number of disadvantages as a construction material, and in particular may not possess sufficient strength to be used on some stairways.

A element for use in constructing a stairway that overcame these problems would be a considerable advantage over existing stairway elements. In particular, if the elements could be attached to each other in some way, and provide for attachment of riser or tread sheets in such a way so as not to compromise the strength or appearance of the stairway then this would be a considerable advantage over present elements for use in relation to stairways.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided an element for use in constructing a stairway, said element comprising a body in a right-angled triangle configuration, one side being the hypotenuse of two adjacent sides, a first of said adjacent sides being longer that a second of said adjacent sides, a flange extending in at least one direction from each of the said sides at an approximate right angle to same, said second adjacent side having a portion in which the flange is absent such that in use adjacent elements can be used to fabricate a stairway by abutting elements together, the adjacent sides providing a mounting portion for a stair tread and/or riser.

According to a further aspect of the present invention there is provided a method of forming a stairway using the element claimed in the above paragraph, and including the step of abutting elements together to form a pair of the side stringers.

As should be appreciated from the above paragraphs preferred embodiments of the present invention may include of an element which has a substantially triangular configuration. On each side of the triangle, preferred embodiments of the present invention may include a flange, which may be configured to extend substantially perpendicularly from the main portion of the element. This flange may either extend along the complete periphery of any side of the element, or, as in the case of the second adjacent side may have at least a portion of the flange which is absent.

By providing an absent portion in the flange of the second adjacent side of preferred embodiments of the present invention, a simple and convenient interlocking means for consecutive elements in, the stairway constructed from the present invention may be provided. In particular, it is envisaged that at least one "corner" portion of each element may be able to be inserted into the missing portion of the flange in an adjacent element. This may provide a means for constructing an interlocking stairway, which may not only be extremely convenient and simple to construct, but may also be particularly strong.

Although some preferred embodiments of the present invention may be substantially planar in appearance it should be appreciated that "kinks" or other similar features may be provided in other preferred embodiments of the present invention. This allows the method of constructing a stairway using elements such as described in the present specification to be extended to spiral (and other shaped) stairways. Similarly, the flange in further preferred embodiments of the present invention may not be a simple right angled flange, and may include other features, such as a sequence of right angles.

In further preferred embodiments of the present invention, it is envisaged that adjacent elements of the presents invention may be abutted together, and then attached in any way to supporting structures such as wooden beams, stringers or any sort, or similar objects. To attach the present invention to such beams or stringers, various methods may be used. For example, the present invention may be screwed, nailed, gang nailed, or attached in any other way to the supporting structures. Accordingly, some embodiments of the present invention may include apertures or other features which may allow particularly simple and quick attachment to the supporting structures of the stairway.

Further preferred embodiments of the present invention may allow the abutted stairway elements to be joined together to form the outer string of the stairway. For example, these embodiments may be attached to each other in such a way so that the main portion of the stairway element faces outward and forms the stair outer string itself. In this way, use of a separate outer string (such as a wooden stinger) is avoided.

In further preferred embodiments of the present invention, the length of either of the sides of the element adjacent to the hypotenuse of the present invention may be varied. For example, should a stairway have a desired riser height, it is envisaged the lengths of the adjacent sides of the present invention may be chosen appropriately.

In addition it is also envisaged that the length of the flanges in the present invention may also be varied to suit desired stairway parameters (eg riser heights). It should also be appreciated that the precise shape, appearance, or other features of the stairway element are not essential to the present invention, and stairway elements of various lengths and configurations may be used in conjunction with the present invention.

Finally, as will be seen in relation with the figures accompanying the specification, the present invention allows for a particularly simple method of constructing stairways. This method includes attaching adjacent stairway elements to each other, and consequently (if necessary) securing the stairway elements to further supporting components (such as wooden beams). Finally, elements such as tread sheets or riser sheets may also be attached to the stairway elements. It should be appreciated that these steps may be performed in any order. In addition, any attachments means may be used to attach either the stairway elements to each other, or the stairway elements to supporting or adjacent structures.

BRIEF DESCRIPTION OF DRAWINGS

Further aspects of the present invention will become apparent from the ensuing description which is given by way of example only and with reference to the accompanying drawings in which.

BEST MODES FOR CARRYING OUT THE INVENTION

Figure 1:
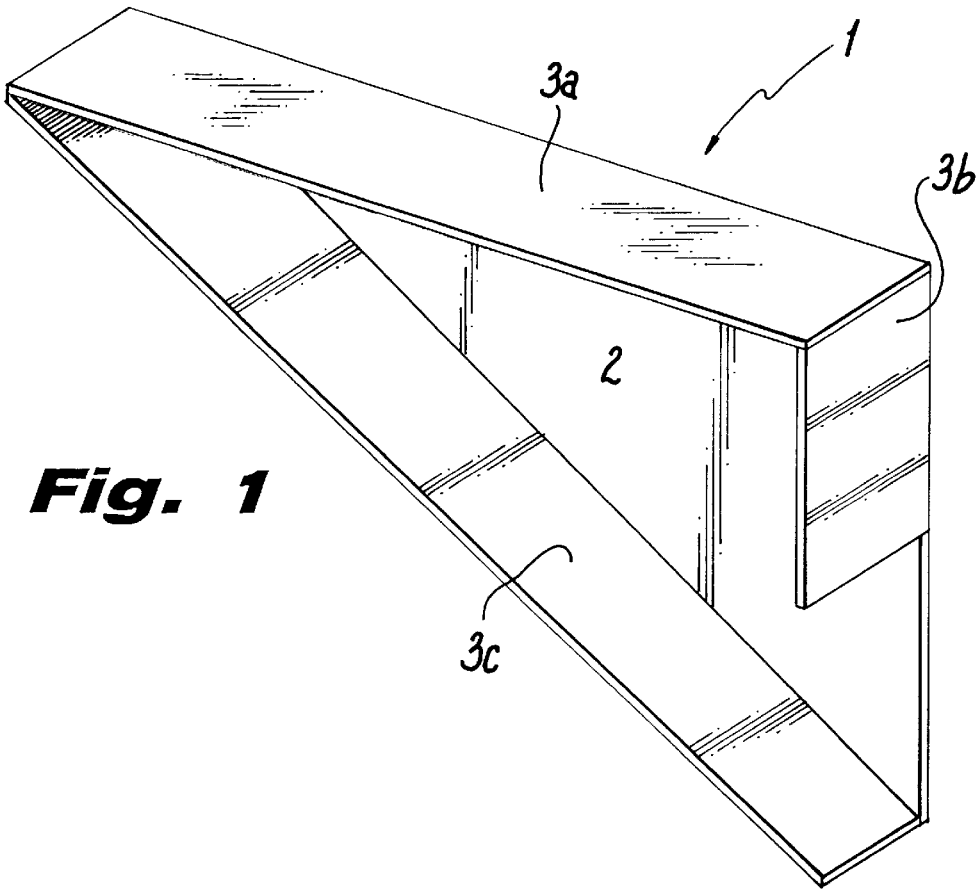
FIG. 1 is a perspective view of a preferred embodiment of the present invention.

With regard to FIG. 1 there is illustrated a stairway element 1. Stairway element 1 includes a body 2, which has a right angled triangular shape, and a number of flanges 3*a*, 3*b*, and 3*c*, which are attached to the sides of body 2. As can be seen, in this embodiment flanges 3*a* and 3*c* extend along the full length of the sides of body 2, while flange 3*b* is a partial flange.

Figure 2:
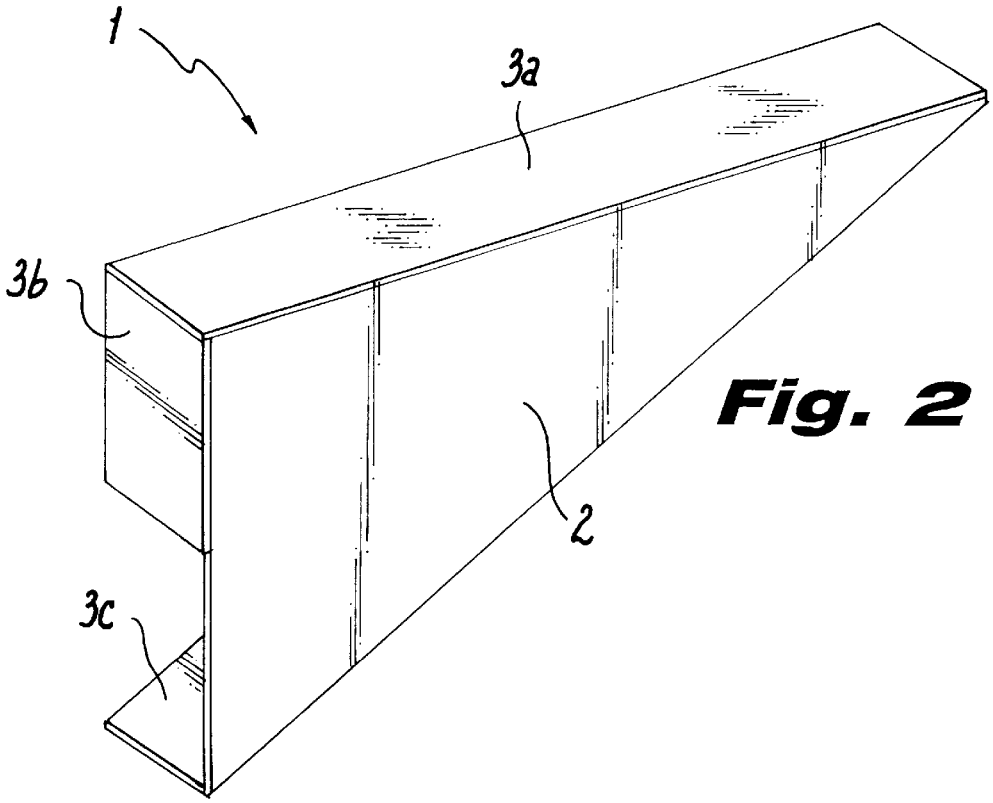
FIG. 2 is a view from a different perspective of the embodiment illustrated in FIG. 1.

FIG. 2 shows a different view of stairway element 1. In this view, body 2 along with flanges 3*a*, 3*b* and 3*c* can all be seen. As will be seen later the portion of flange 3*b* which is missing allows for adjacent stairway elements to abut each other, which provides a simple and effective means of attaching the stairway elements 1 to each other.

Figure 2A:
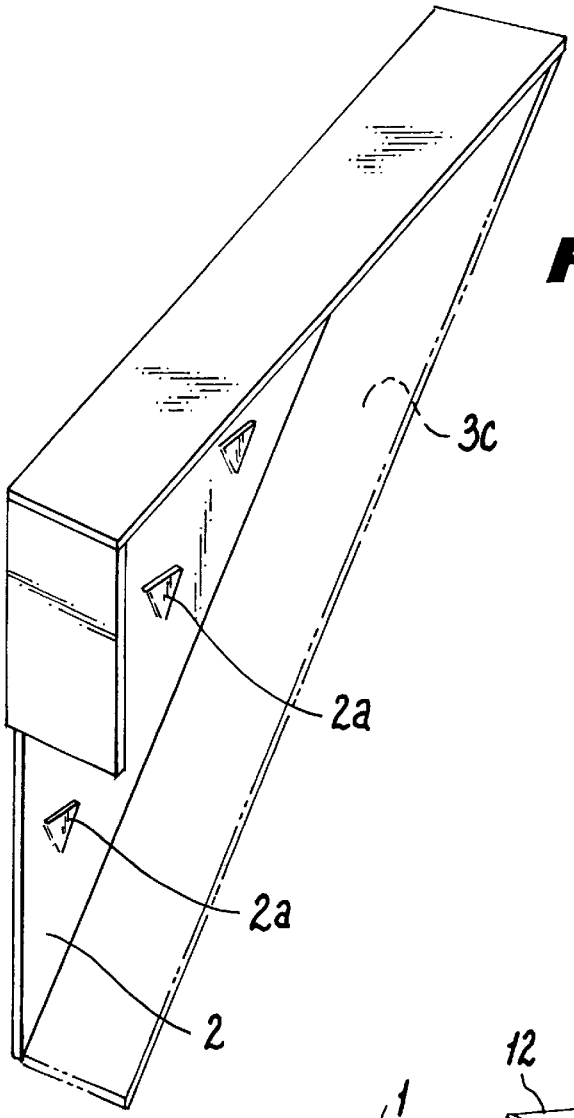
FIG. 2*a* is a view of an alternative embodiment of the present invention and, FIG. 3 is a perspective view of a partial stairway constructed using a preferred embodiment of the present invention.

In FIG. 2*a* a further alternative or complimentary embodiment of the present invention is shown. In this embodiment flange 3*c* is optional and body 2 is provided with nail barbs 2*a*. This embodiment can be used separately or in conjunction with the other variations described to form a stair tread.

Figure 3:
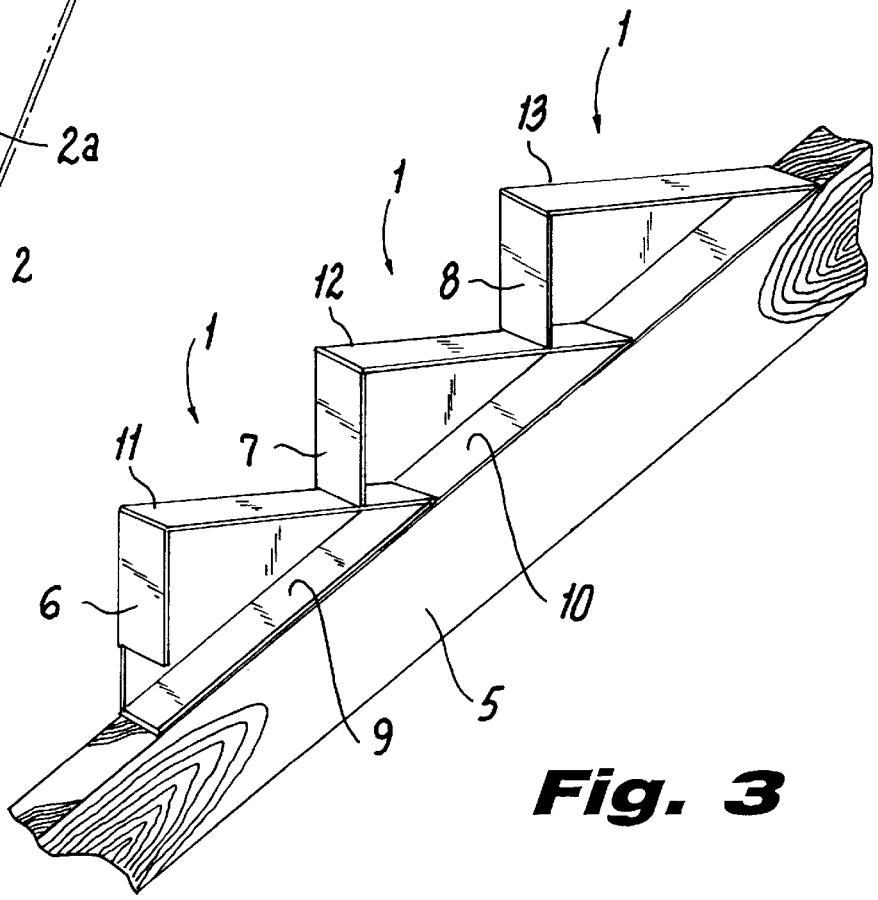

FIG. 3 shows a possible means of using stairway elements 1 to construct a stairway. As can be seen in this figure, a number of adjacent elements 1 are abutted together and attached to a beam 5. Flanges 6, 7 and 8 (corresponding to flange 3*b* in FIGS. 1 and 2) allow corners 9 and 10 of stairway elements 1 to abut into the corresponding body of the adjacent stairway elements, allowing the elements to firmly interlock with each other. The stairway elements 1 may subsequently be attached to the beam 5 in any appropriate manner, for example by nailing, screwing or gang nailing. In addition, the abutting portions of adjacent stairway elements may also be attached to each other to provide for extra strength of the stairway.

In addition, as can be seen, flanges 6, 7 and 8 provide an especially convenient means for riser sheets to be attached to the stair way, and flanges 11, 12 and 13 provide for an especially convenient means for tread sheets to be attached to the stairway elements 1.

As has been mentioned, the shape and configuration of the flanges, together with the body elements in elements 1 may be varied depending on the shape and configuration of the stairway desired to be constructed. Variations of stairway elements are shown in FIGS. 4 to 6.

Figure 4:
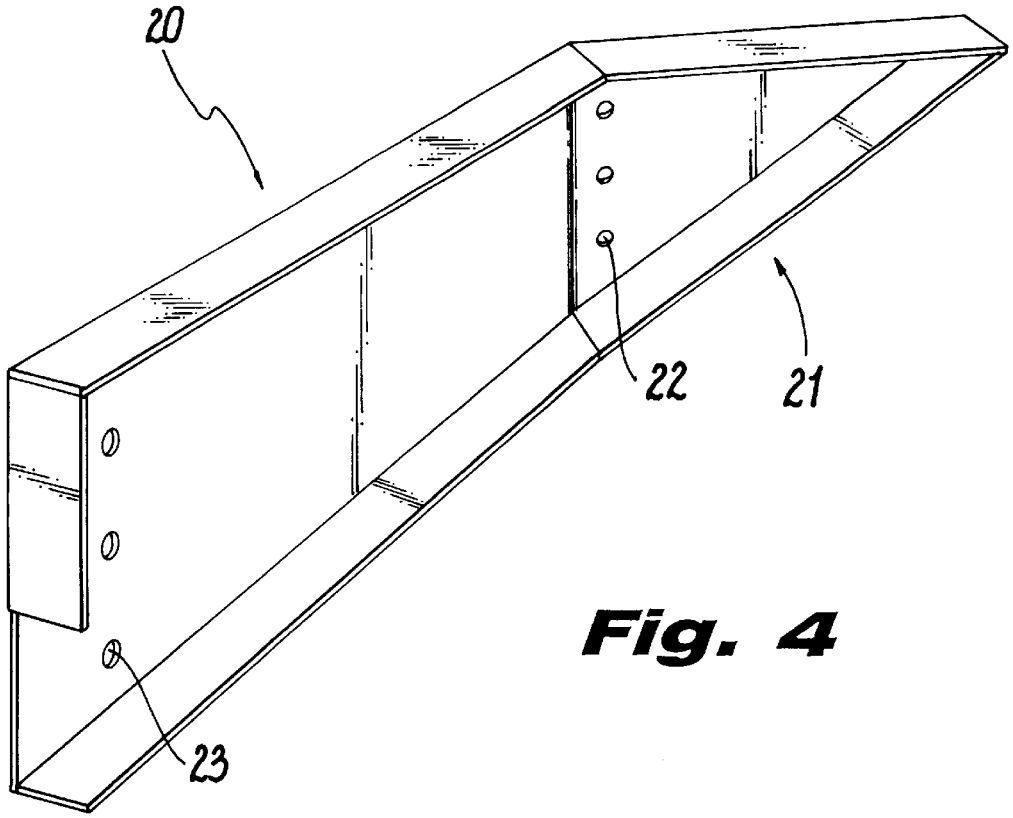
FIGS. 4 & 4*a* are perspective views of an alternative preferred embodiment of the present invention.
Figure 4A:
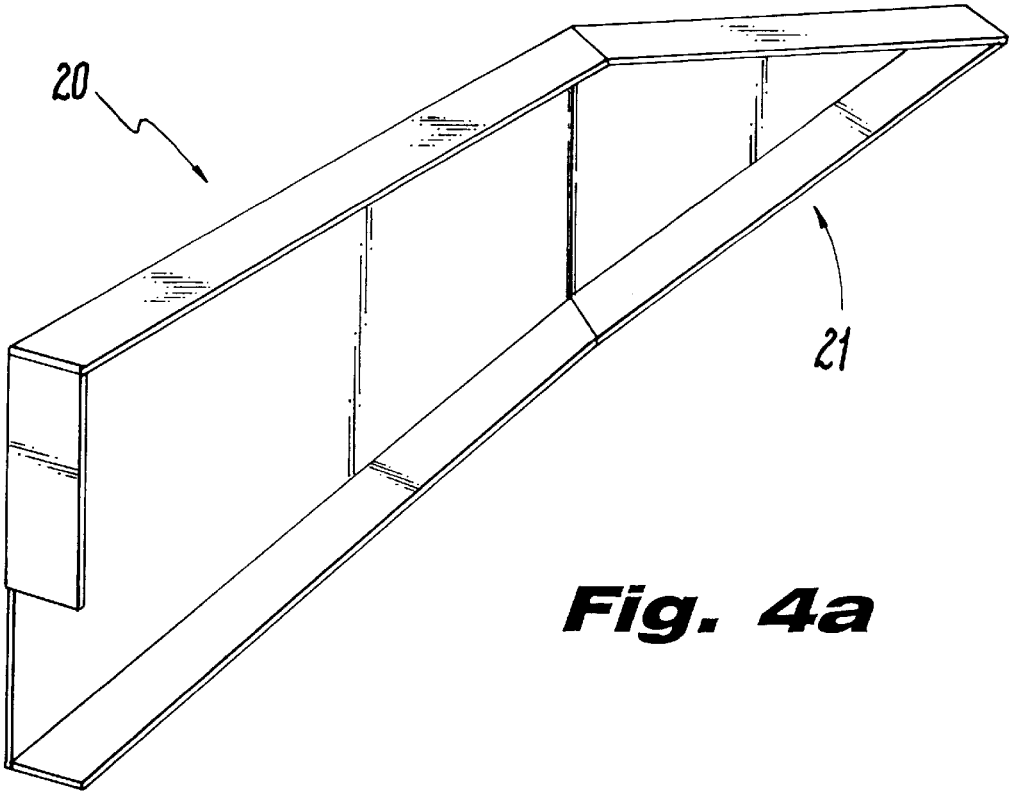

In FIG. 4 and 4*a*, there is shown a stairway element 20 varying from those illustrated in the previous figures by including a "kinked" portion 21. This kinked portion 21 comprises of a substantially triangular shape portion of the body of stairway element 20, which has been angled slightly to allow for a non-linear stairway to be constructed using this element. As can be seen stairway element 20 also includes flanges as described in the previous embodiments, but may also include apertures 22 or 23 which may provide an easy means for attachment of stairway element 20 onto other supporting structures. The position and configuration of apertures 22 and 23 may also be varied.

Figure 5:
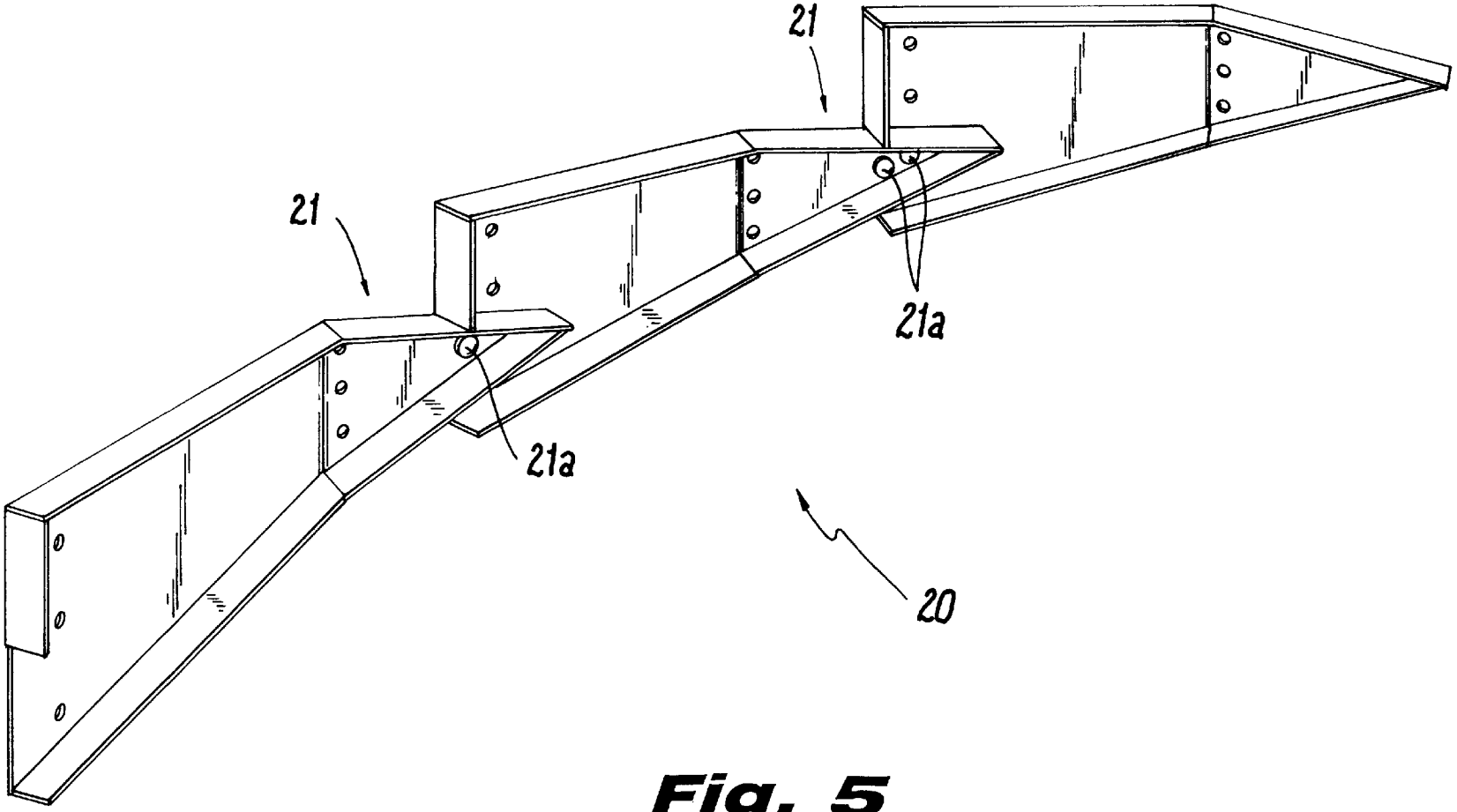
FIG. 5 is a perspective view of a number of embodiments of the present invention illustrated in FIG. 4 abutted together.

FIG. 5 shows an appropriate means of connecting a number of stairway elements 20 (as shown in FIG. 4) together. As can be seen these elements may abut each other in a similar way as shown in FIG. 3, with the difference being that the kinked portion 21 of stairway element 20 allow for the direction of adjacent abutting stairway elements to be varied. This is particularly useful in the construction of spiral, circular, or other stairways. The portions 21 can be bolted together with bolts 21*a* so that the structure is self-supporting.

Figure 6:
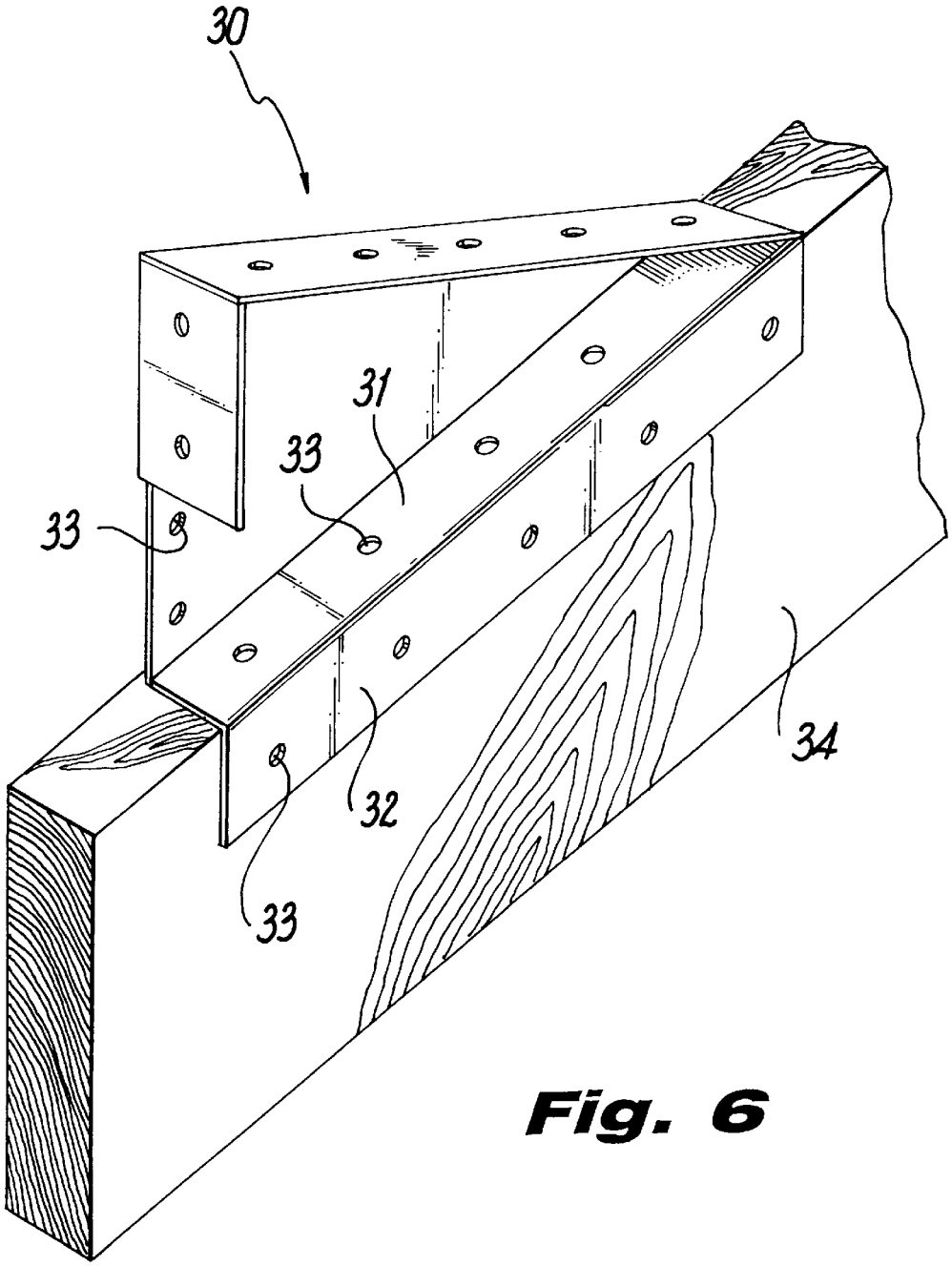
FIG. 6 is a perspective view of a further preferred embodiment of the present invention.

With regard to FIG. 6 there is illustrated a further preferred embodiment of stairway element 30. This element 30 has a substantially triangular shaped body as the embodiments illustrated in FIGS. 1 to 3 did, but includes a flange 31 which has an extra right angled portion 32. In addition, a number of apertures 33 are also provided for attachment of the element 32 to an adjacent supporting structure 34 (such as a wooden beam). The extra right angled flange 32 in this element not only allows for easy attachment of the element to the supporting structure 34, but also ensures that this element is self supporting (ie may balance on the beam 34 without any further attachment means). This can make attachment of the element 32 to the supporting structure 34, and subsequent construction of the stairway, especially simple.

Aspects of the present invention have been described by way of example only and it should be appreciated that modifications and additions may be made thereto without departing from the scope thereof as defined in the appended claims.

I claim:

1. An element for use in constructing a stairway, said element comprising a body in a right-angled triangle configuration, one side of said body being the hypotenuse of two adjacent sides, a first of said adjacent sides being longer than a second of said adjacent sides, said first adjacent side and said hypotenuse forming a first acute corner of said body, said second adjacent side and said hypotenuse forming a second acute corner of said body, a flange extending in at least one direction from each of the said sides at an approximate right angle to said body, said second adjacent side having a portion in which the flange is absent, said absent flange portion proximal to said second acute corner of said body, said absent flange portion dimensioned to receive said first acute corner of an adjacent element such that in use adjacent elements can be used to fabricate a stairway by interlocking consecutive abutting elements together, the flanges of the adjacent sides providing a mounting portion for a stair tread and/or riser.

2. An element as claimed in claim 1 including fixing means by which each of the abutted elements can be joined together to form a stair outer stringer.

3. An element as claimed in claim 2 wherein the flange of the second side has a fixed length, and a portion of said fixed length of the flange of the second side can be cut away to suit a desired riser height.

4. A method of forming a stairway using the element claimed in claim 3 including the step of abutting and securing elements together to form a pair of side stringers and mounting treads and/or risers between the stringers.

5. A method of forming a stairway using the element claimed in claim 4 including the step of abutting elements together and mounting same on a complimentary stringer member and mounting treads and/or risers between the stringers.

6. An element for use in constructing a stairway, said element comprising a body in a right-angled triangle configuration, one side of said body being the hypotenuse of two adjacent sides, a first of said adjacent sides being longer than a second of said adjacent sides, said first adjacent side and said hypotenuse forming a first acute corner of said body, said second adjacent side and said hypotenuse forming a second acute corner of said body, a flange extending in at least one direction from each of the said sides at an approximate right angle to said body, said second adjacent side having a portion in which the flange is absent, said absent flange portion proximal to said second acute corner of said body, said absent flange portion dimensioned to receive said first acute corner of an adjacent element such that in use adjacent elements can be used to fabricate a self-supporting stairway stringer by interlocking consecutive abutting elements together, the flanges of the adjacent sides providing a mounting portion for a stair tread and/or riser.

* * * * *

UNITED STATES PATENT AND TRADEMARK OFFICE

CERTIFICATE OF CORRECTION

PATENT NO. : 5,806,254

DATED : September 15, 1998

INVENTOR(S) : Michael Hebden Bennett

It is certified that error appears in the above-identified patent and that said Letters Patent is hereby corrected as shown below:

On the title page, add item [30] Priority:

Foreign Application Priority Data

Mar. 04, 1996 [AU] Australia.....PN 8411

Signed and Sealed this

Sixteenth Day of February, 1999

*Attest:*

*Attesting Officer*

*Acting Commissioner of Patents and Trademarks*